US010054342B2

(12) United States Patent
Chen et al.

(10) Patent No.: US 10,054,342 B2
(45) Date of Patent: Aug. 21, 2018

(54) AIR CONDITIONER

(71) Applicant: Delta Electronics, Inc., Taoyuan (TW)

(72) Inventors: Lee-Long Chen, Taoyuan (TW); Chia-Wei Chen, Taoyuan (TW); Jian-Jhang Wu, Taoyuan (TW); Chun-Yang Hung, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 241 days.

(21) Appl. No.: 15/004,979

(22) Filed: Jan. 24, 2016

(65) Prior Publication Data

US 2016/0282034 A1 Sep. 29, 2016

(30) Foreign Application Priority Data

Mar. 24, 2015 (CN) ..... 2015 1 0130343

(51) Int. Cl.

| | |
|---|---|
| ***F25D 17/06*** | (2006.01) |
| ***F25B 39/00*** | (2006.01) |
| ***F24F 1/46*** | (2011.01) |
| *F28D 1/053* | (2006.01) |

(52) U.S. Cl.

CPC ..... *F25B 39/00* (2013.01); *F24F 1/46* (2013.01); *F28D 1/05391* (2013.01)

(58) Field of Classification Search

CPC ..... F25B 39/04; F25B 39/00; F25B 31/006; F24F 1/24; F24F 1/52; F24F 1/46; F24F 1/48

See application file for complete search history.

(56) References Cited

U.S. PATENT DOCUMENTS

| | | | | |
|---|---|---|---|---|
| 2004/0163407 | A1* | 8/2004 | Kim | F24F 1/52 62/428 |
| 2007/0296315 | A1* | 12/2007 | Francisquini | F24F 1/022 312/236 |
| 2011/0198065 | A1* | 8/2011 | Hanafusa | F25B 39/04 165/173 |
| 2013/0086931 | A1* | 4/2013 | Chen | F25B 41/003 62/115 |

* cited by examiner

*Primary Examiner* — Elizabeth Martin

(74) *Attorney, Agent, or Firm* — Muncy, Geissler, Olds & Lowe, P.C.

(57) ABSTRACT

An air conditioner is provided that includes an outer circulation unit. The outer circulation unit includes an outer circulation housing, an outer circulation inlet, an outer circulation outlet, and a condenser. The outer circulation inlet is formed on the outer circulation housing. The outer circulation outlet is formed on the outer circulation housing. An outer circulation flow enters the outer circulation unit via the outer circulation inlet, passes through the condenser to remove heat from the condenser, and leaves the outer circulation unit via the outer circulation outlet, wherein the height of the outer circulation inlet is higher than the height of the outer circulation outlet in a vertical direction.

7 Claims, 5 Drawing Sheets

AIR CONDITIONER

CROSS REFERENCE TO RELATED APPLICATIONS

This Application claims priority of China Patent Application No. 201510130343.4, filed on Mar. 24, 2015, the entirety of which is incorporated by reference herein.

BACKGROUND OF THE INVENTION

Field of the Invention

The present invention relates to an air conditioner, and in particular to an air conditioner preventing hot air from being re-inhaled.

Description of the Related Art

Conventional air conditioners include an evaporator (inner circulation), a condenser (outer circulation), a compressor and an expansion valve. The compressor pressurizes a high-temperature refrigerant and moves the refrigerant to the condenser. A condenser fan blows an outer circulation flow toward the condenser to remove the heat therefrom, such that the refrigerant is cooled into liquid form. Then, the refrigerant passes through the expansion valve or a capillary to decrease the pressure and the temperature of the refrigerant. Next, the refrigerant enters the evaporator. An evaporator fan blows an inner circulation flow toward the low temperature evaporator to decrease the temperature of the inner circulation flow. The refrigerant is gasified due to the heat absorbed in the evaporator, and then travels back to the compressor.

In the conventional air conditioner, the hot air exhausted from the outer circulation unit is usually re-inhaled into the outer circulation unit, and the heat dissipation efficiency of the air conditioner is thereby decreased.

BRIEF SUMMARY OF THE INVENTION

An air conditioner is provided includes an outer circulation unit. The outer circulation unit includes an outer circulation housing, an outer circulation inlet, an outer circulation outlet and a condenser. The outer circulation inlet is formed on the outer circulation housing. The outer circulation outlet is formed on the outer circulation housing. An outer circulation flow enters the outer circulation unit via the outer circulation inlet, passes through the condenser to remove heat from the condenser, and leaves the outer circulation unit via the outer circulation outlet, wherein a height of the outer circulation inlet is higher than a height of the outer circulation outlet in a vertical direction.

Utilizing the air conditioner of the embodiment of the invention, the height of the outer circulation inlet is higher than the height of the outer circulation outlet in the vertical direction, and the blades tilt toward the ground. Therefore, the hot air exhausted from the outer circulation outlet is blown away from the outer circulation inlet, and is prevented from being re-inhaled into the outer circulation unit, and the heat dissipation efficiency of the outer circulation unit is thereby improved.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
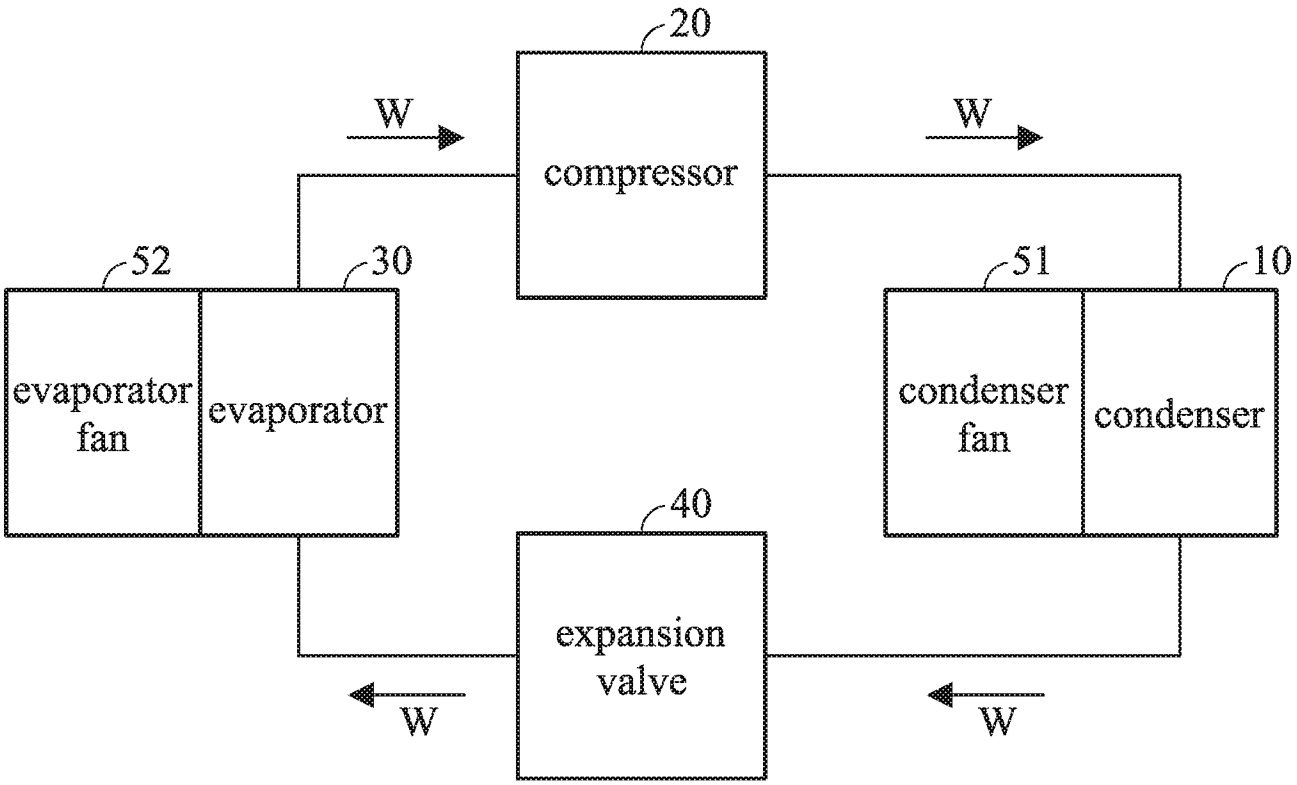
FIG. 1 is a block diagram of an air conditioner of an embodiment of the invention.

FIG. 1 is a block diagram of an air conditioner 1 of an embodiment of the invention. The air conditioner 1 comprises a condenser 10, a compressor 20, an evaporator 30, an expansion valve 40, a condenser fan 51, and an evaporator fan 52. The compressor 20 pressurizes a high-temperature working fluid W (such as refrigerant) and moves the working fluid W to the condenser 10. The condenser fan 51 blows an outer circulation flow toward the condenser 10 to remove the heat therefrom. The working fluid W is cooled into liquid form. Then, the working fluid W passes through the expansion valve 40 (in another embodiment, and the expansion valve can be replaced by a capillary), the pressure and the temperature of the working fluid W is decreased. Next, the working fluid W enters the evaporator 30. The evaporator fan 52 blows an inner circulation flow toward the low temperature evaporator 30 to decrease the temperature of the inner circulation flow. The working fluid W is gasified due to the heat absorbed in the evaporator 30, and then circulates back to the compressor 20.

Figure 2:
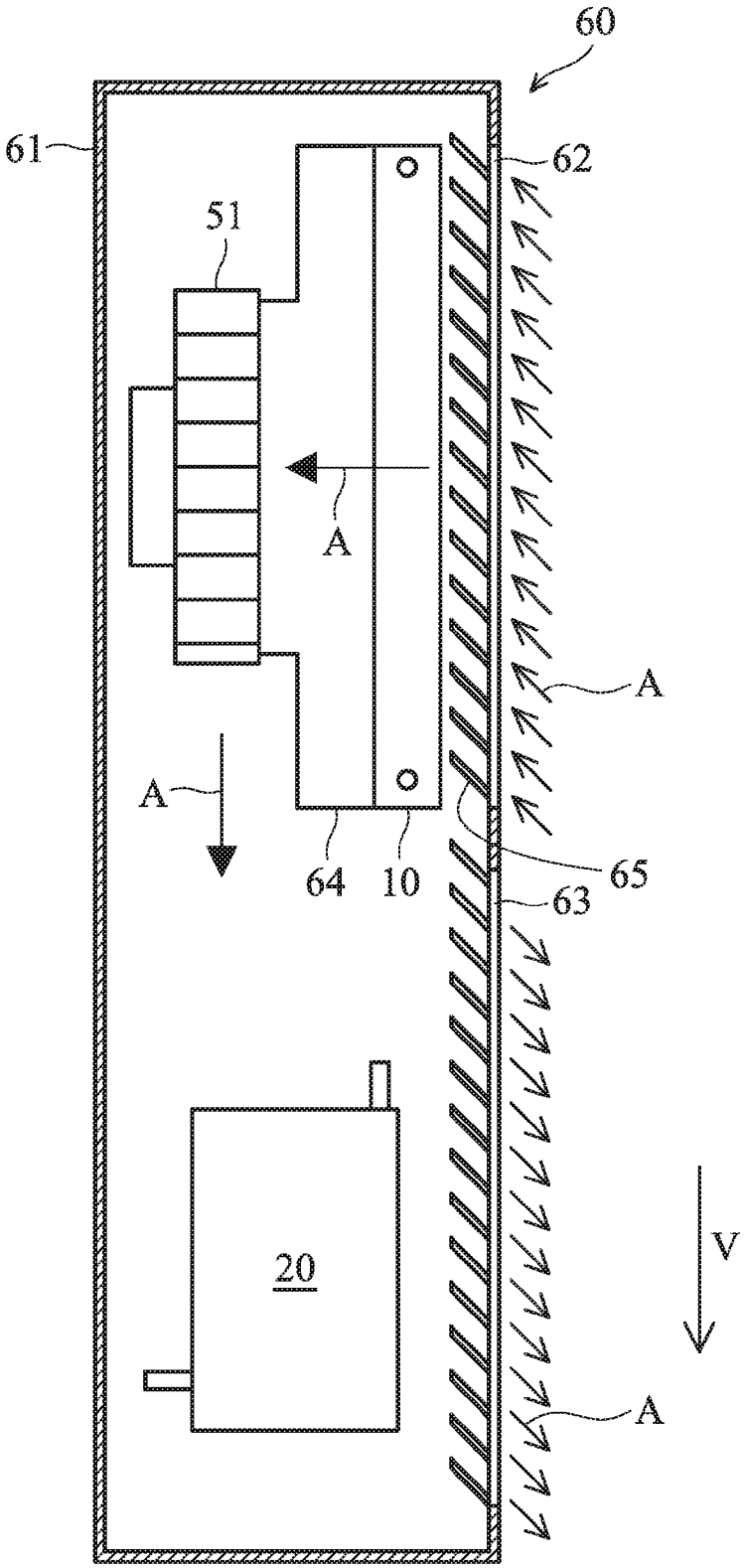
FIG. 2 shows an outer circulation unit of the air conditioner of an embodiment of the invention.

FIG. 2 shows an outer circulation unit of the air conditioner of an embodiment of the invention. The air conditioner 1 comprises the outer circulation unit 60. The outer circulation unit 60 comprises the condenser 10, the condenser fan 51, an outer circulation housing 61, an outer circulation inlet 62, and an outer circulation outlet 63. The outer circulation inlet 62 is formed on the outer circulation housing 61. The outer circulation outlet 63 formed on the outer circulation housing 61. The condenser 10 is disposed in the outer circulation unit 60. An outer circulation flow A enters the outer circulation unit 60 via the outer circulation inlet 62, passes through the condenser 10 to remove heat from the condenser 10, and leaves the outer circulation unit 60 via the outer circulation outlet 63. The height of the outer circulation inlet 62 is higher than the height of the outer circulation outlet 63 in a vertical direction V.

With reference to FIG. 2, in this embodiment, the compressor 20 is disposed in the outer circulation unit 60, and the height of the condenser 10 is higher that the height of the compressor 20 in the vertical direction V. The outer circulation flow A enters the outer circulation unit 60 via the outer circulation inlet 61, passes through the condenser 10 to remove heat from the condenser 10, the passes through the compressor 20 to remove heat from the compressor 20, and leaves the outer circulation unit 60 via the outer circulation outlet 63. The temperature of the compressor 20 is usually higher than the temperature of the condenser 10. Therefore, the outer circulation flow A passes through the condenser 10 first, and then passes through the compressor 20 to achieve improved heat dissipation efficiency.

With reference to FIG. 2, in this embodiment, the condenser fan 51 is corresponding to the condenser 10, and the height of the condenser fan 51 is higher than the height of the compressor 20 in the vertical direction V. Therefore, the outer circulation flow A passes through the condenser 10 first, and then passes through the compressor 20. The noise generated from the condenser fan 51 can be insulated by the condenser 10.

With reference to FIG. 2, in this embodiment, the outer circulation unit 60 further comprises a guiding shield 64, and the guiding shield 64 is communicated to the condenser 10 and the condenser fan 51. The air pressure of the outer circulation flow A passing the condenser 10 is therefore enhanced.

With reference to FIG. 2, in this embodiment, the outer circulation housing 61 comprises a plurality of blades 65. The blades 65 are disposed at the outer circulation inlet 62 and the outer circulation outlet 63. The blades 65 tilt toward the ground. Therefore, rain and dust is prevented from entering the outer circulation unit 60.

In the air conditioner 1 of the embodiment of the invention, the height of the outer circulation inlet 62 is higher than the height of the outer circulation outlet 63 in the vertical direction V, and the blades 65 tilt toward the ground. Therefore, the hot air exhausted from the outer circulation outlet 63 is blown away from the outer circulation inlet 62, and is prevented from being re-inhaled into the outer circulation unit 60, and the heat dissipation efficiency of the outer circulation unit 60 is thereby improved.

Figure 3:
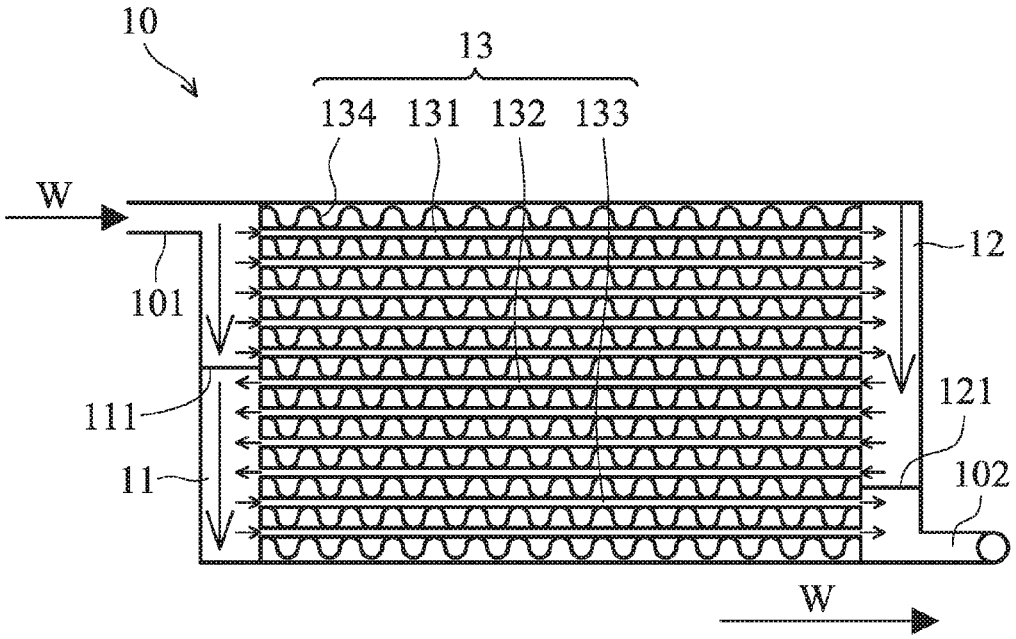
FIG. 3 shows the detailed structure of the condenser of the embodiment of the invention.

With reference to FIG. 3, in one embodiment, the condenser 10 is a flat pipe condenser. The condenser 10 comprises a fluid inlet 101, a fluid outlet 102, a plurality of flat pipes 13, a first side pipe 11 and a second side pipe 12. The first side pipe 11 comprises at least one first spacer 111, and a working fluid W enters the first side pipe 11 via the fluid inlet 101, guided by the first spacer 111, passing through the flat pipes 13, circulating in the flat pipes 13 between the first side pipe 11 and the second side pipe 12, and leaves the condenser 10 via the fluid outlet 102.

Figure 4:
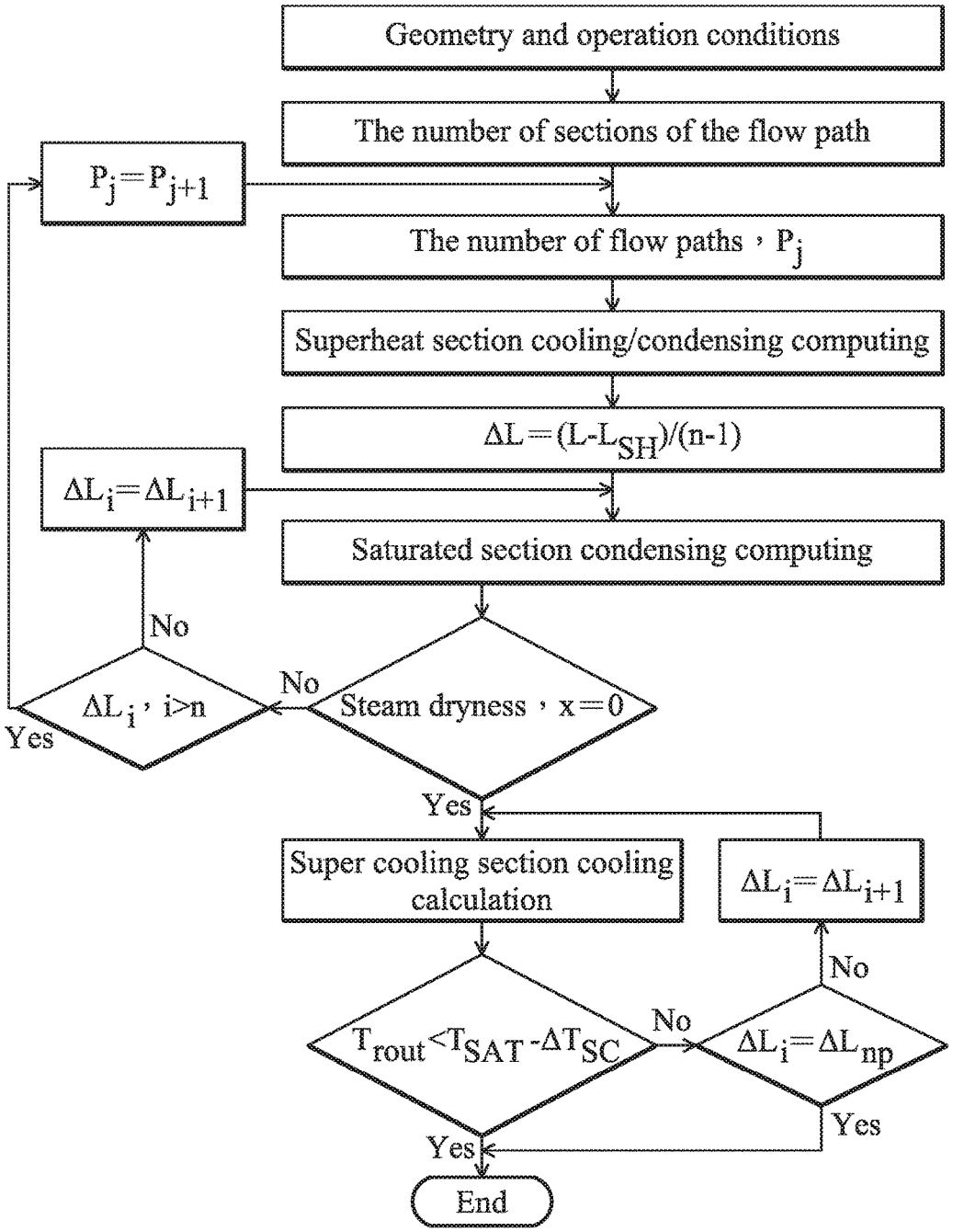
FIG. 4 shows the design method of the condenser of the embodiment of the invention.

With reference to FIG. 3, in one embodiment, the flat pipes 13 comprise a plurality of first flat pipes 131, a plurality of second flat pipes 132, a plurality of third flat pipes 133 and a plurality of heat dissipation fins 134. The heat dissipation fins 134 are disposed on the first flat pipes 131, the second flat pipes 132 and the third flat pipes 133 to increase the heat dissipation area. The second side pipe 12 comprises at least one second spacer 121, and the working fluid W enters the first side pipe 11 via the fluid inlet 101, guided by the first spacer 111, passing through the first flat pipes 131 to the second side pipe 12. Next, the working fluid W is guided by the second spacer 121, passing through the second flat pipes 132 to the first side pipe 11. Then, the working fluid W is guided by an end of the first side pipe 11, passing through the third flat pipes 133 to the second side pipe 12, and leaves the condenser 10 via the fluid outlet 102. In this embodiment, the number N1 of first flat pipes 131 is greater than the number N2 of second flat pipes 132, and the number N2 of second flat pipes 132 is greater than the number N3 of third flat pipes 133. In one embodiment, the ratio of the number of flat pipes N1:N2:N3 can be 6:3:1. With reference to FIG. 4, the ratio of the number of flat pipes can be calculated through the parameters such as geometry, operating conditions, steam dryness, wherein L is the width of a heat exchanger, p is the number of flow paths and T is the temperature of the refrigerant. The condensation efficiency of the condenser is optimized. In another embodiment, the flow direction inside the flat pipes can be modified, and the fluid outlet can be selectively formed on the first side pipe or the second side pipe without increasing the dimensions of the condenser. The design flexibility of the air conditioner is increased.

Figure 5:
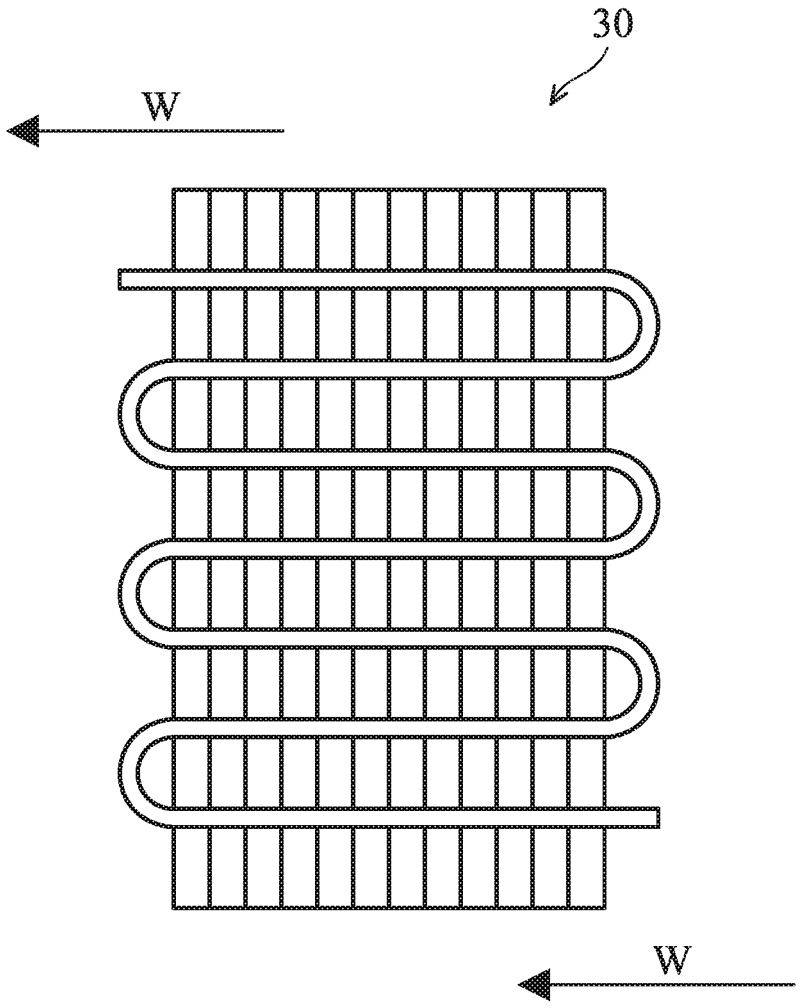
FIG. 5 shows the detailed structure of the evaporator of the embodiment of the invention.

With reference to FIG. 5, in one embodiment, the inner circulation evaporator 30 is a circular copper pipe evaporator, and the outer circulation condenser is a flat pipe condenser. Therefore, the flat pipe condenser is utilized as the outer circulation condenser to provide advantages such as large heat dissipation area and low wind resistance, and the circular copper pipe evaporator is utilized as the inner circulation evaporator to provide advantages such as improved drainage.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An air conditioner, comprising:

an outer circulation unit, comprising:

an outer circulation housing;

an outer circulation inlet, formed on the outer circulation housing;

an outer circulation outlet, formed on the outer circulation housing; and a condenser, wherein an outer circulation flow enters the outer circulation unit via the outer circulation inlet, passes through the condenser to remove heat from the condenser, and leaves the outer circulation unit via the outer circulation outlet, wherein a height of the outer circulation inlet is higher than a height of the outer circulation outlet in a vertical direction;

wherein the condenser comprises a fluid inlet, a fluid outlet, a plurality of flat pipes, a first side pipe and a second side pipe, the first side pipe comprises at least one first spacer, and a working fluid enters the first side pipe via the fluid inlet, guided by the first spacer, passing through the flat pipes, circulating in the flat pipes between the first side pipe and the second side pipe, and leaves the condenser via the fluid outlet, wherein the flat pipes comprise a plurality of first flat pipes, a plurality of second flat pipes, a plurality of third flat pipes and a plurality of heat dissipation fins, the heat dissipation fins are disposed on the first flat pipes, the second flat pipes and the third flat pipes, the second side pipe comprises at least one second spacer, and the working fluid enters the first side pipe via the fluid inlet, guided by the first spacer, passing through the first flat pipes to the second side pipe, then guided by the second spacer, passing through the second flat pipes to the first side pipe, then guided by an end of the first side pipe, passing through the third flat pipes to the second side pipe, and leaves the condenser via the fluid outlet, wherein the number N1 of first flat pipes is greater than the number N2 of second flat pipes, the number N2 of second flat pipes is greater than the number N3 of third flat pipes, and the ratio of the number of flat pipes Nl:N2:N3 is 6:3:1.

2. The air conditioner as claimed in claim 1, further comprising a compressor, wherein the compressor is disposed in the outer circulation unit, and a height of the condenser is higher that a height of the compressor in the vertical direction.

3. The air conditioner as claimed in claim 2, wherein the outer circulation flow enters the outer circulation unit via the outer circulation inlet, passes through the condenser to remove heat from the condenser, then passes through the compressor to remove heat from the compressor, and leaves the outer circulation unit via the outer circulation outlet.

4. The air conditioner as claimed in claim 3, wherein the outer circulation unit further comprises a condenser fan corresponding to the condenser, and a height of the condenser fan is higher than the height of the compressor in the vertical direction.

5. The air conditioner as claimed in claim 4, wherein the outer circulation unit further comprises a guiding shield, and the guiding shield is communicated to the condenser and the condenser fan.

6. The air conditioner as claimed in claim 4, wherein the outer circulation housing comprises a plurality of blades, the blades are disposed at the outer circulation inlet and the outer circulation outlet, and the blades tilt toward a ground direction.

7. The air conditioner as claimed in claim 1, further comprising a circular copper pipe evaporator, a compressor and an expansion valve, wherein a working fluid circulates between the circular copper pipe evaporator, the compressor, the condenser and the expansion valve.

* * * * *